US011448453B2

(12) United States Patent
Toyooka et al.

(10) Patent No.: US 11,448,453 B2
(45) Date of Patent: Sep. 20, 2022

(54) REFRIGERATION DEVICE

(71) Applicant: PHC HOLDINGS CORPORATION, Tokyo (JP)

(72) Inventors: Takashi Toyooka, Saitama (JP); Tadashi Okada, Saitama (JP); Jun Yoshioka, Ehime (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 405 days.

(21) Appl. No.: 16/692,988

(22) Filed: Nov. 22, 2019

(65) Prior Publication Data

US 2020/0088455 A1 Mar. 19, 2020

Related U.S. Application Data

(63) Continuation of application No. PCT/JP2018/017859, filed on May 9, 2018.

(30) Foreign Application Priority Data

May 24, 2017 (JP) ..... JP2017-102872

(51) Int. Cl.
*F25D 21/04* (2006.01)
*F25D 11/02* (2006.01)
*F25D 23/02* (2006.01)

(52) U.S. Cl.
CPC ..... *F25D 21/04* (2013.01); *F25D 11/02* (2013.01); *F25D 23/028* (2013.01)

(58) Field of Classification Search
CPC ..... F25D 23/02; F25D 23/028; F25D 21/04; F25D 11/02; F25B 47/006; F28D 1/0477; F28D 5/02; F28F 9/02
See application file for complete search history.

(56) References Cited

U.S. PATENT DOCUMENTS 3,984,223 A 10/1976 Whistler, Jr.
4,950,869 A * 8/1990 Mueller ..... F25D 23/021 219/218
6,138,341 A * 10/2000 Barroero ..... E06B 3/6621 29/527.1

(Continued)

FOREIGN PATENT DOCUMENTS

CN 201892362 U 7/2011
JP S56-15980 U 2/1981
JP S57-144391 U 9/1982

(Continued)

OTHER PUBLICATIONS

Sia, "Refrigerator", Mar. 29, 2007; eSpacenet, all (Year: 2007).*

(Continued)

*Primary Examiner* — Filip Zec
(74) *Attorney, Agent, or Firm* — McDermott Will & Emery LLP

(57) ABSTRACT

This refrigeration device, which cools by means of a refrigeration cycle using a refrigerant, is provided with: a door; a box which has a peripheral edge that is opposite of the outer peripheral portion of the door when the door is in a closed state, and which is internally cooled by the refrigerant; and multiple pipes which are arranged along the surface of the peripheral edge and which circulate a refrigerant warmed by the compression action of a compressor.

8 Claims, 12 Drawing Sheets

(56) References Cited

U.S. PATENT DOCUMENTS

| | | | |
|---|---|---|---|
| 8,555,663 | B2 | 10/2013 | Shinya et al. |
| 2011/0030402 | A1 | 2/2011 | Shinya et al. |

FOREIGN PATENT DOCUMENTS

| | | | |
|---|---|---|---|
| JP | H06-159903 | A | 6/1994 |
| JP | 2002-062021 | A | 2/2002 |
| JP | 2005-147476 | A | 6/2005 |
| JP | 2007-078282 | A | 3/2007 |
| JP | 2008-107045 | A | 5/2008 |
| JP | 2011-237115 | A | 11/2011 |
| JP | 2016-183837 | A | 10/2016 |
| KR | 10-1031132 | B1 | 4/2011 |

OTHER PUBLICATIONS

Extended European Search Report dated Mar. 27, 2020 for the corresponding European Patent Application No. 18805684.0.

International Search Report and Written Opinion issued in International Patent Application No. PCT/JP2018/017859, dated Aug. 7, 2018; with partial English translation.

* cited by examiner

REFRIGERATION DEVICE

CROSS-REFERENCE OF RELATED APPLICATIONS

This application is the U.S. Continuation of International Patent Application No. PCT/JP2018/017859, filed on May 9, 2018, which in turn claims the benefit of Japanese Application No. 2017-102872, filed on May 24, 2017, the entire disclosures of which Applications are incorporated by reference herein.

TECHNICAL FIELD

The present invention relates to a refrigeration apparatus.

BACKGROUND ART

Conventionally, there have been used refrigeration apparatuses that include a box section including an interior space that is cooled by a refrigeration circuit. In such a refrigeration apparatus, an opening communicating with the interior space of the box section, and a door configured to be opened and closed freely is provided on the box section.

In the refrigeration apparatus described above, a portion defined between a circumferential edge portion of the opening and the door tends to have lower heat insulation properties than those of the other portions. As a result, condensation or frosting tends to occur more easily at the portion defined between the circumferential edge portion of the opening and the door than at the other portions.

PTL 1 discloses an invention for preventing such condensation or frosting. That is, PTL 1 discloses a stocker in which sliding rubber is provided on the periphery of a lower end portion of a door, and a heat insulated space defined by the sliding rubber is heated by a heater wire. Thus, condensation or frosting can be prevented which would otherwise be caused on the periphery of the lower end portion of the door.

CITATION LIST

Patent Literature

PTL 1
Japanese Patent Application Laid-Open No. 2005-147476

SUMMARY OF INVENTION

Technical Problem

According to a stocker described in PTL 1, there are possibilities that condensation or frosting can be prevented from being generated on the periphery of the lower end portion of the door, that is, on the periphery of a lower end portion of an opening in the stocker. However, it cannot be expected to prevent such condensation or frosting from being generated at other portions than the periphery of the lower end portion of the opening in the stocker.

An object of the present invention, which has been made in view of these situations, is to provide a refrigeration apparatus that can prevent condensation and frosting from being generated on the periphery of an opening circumferential portion that surrounds an opening.

Solution to Problem

A refrigeration apparatus according to the present invention is a refrigeration apparatus configured to perform cooling through a refrigeration cycle using a refrigerant, the refrigeration apparatus including; a door, a box section including a circumferential edge section that faces an outer circumferential portion of the door with the door closed, in which an interior of the box section is cooled by the refrigerant, packing configured to be held between the outer circumferential portion of the door and the circumferential edge section with the door closed, and a plurality of pipes disposed so as to be aligned along a surface of the circumferential edge section, the plurality of pipes circulating the refrigerant that is warmed by a compressing action of a compressor, and the plurality of pipes include a first annular pipe and a second annular pipe that is disposed in such a manner as to be superposed on an outer circumferential side of the first annular pipe so as to wrap around the first annular pipe.

Advantageous Effects of Invention

According to the present invention, the refrigeration apparatus can be provided in which condensation and frosting can be prevented from being generated on the periphery of the opening circumferential portion that surrounds the opening.

DESCRIPTION OF EMBODIMENTS

Embodiments of the present invention will be described in detail with reference to accompanying drawings. The following embodiments are examples, and the present invention is not limited by these embodiments in any way.

Figure 1A:
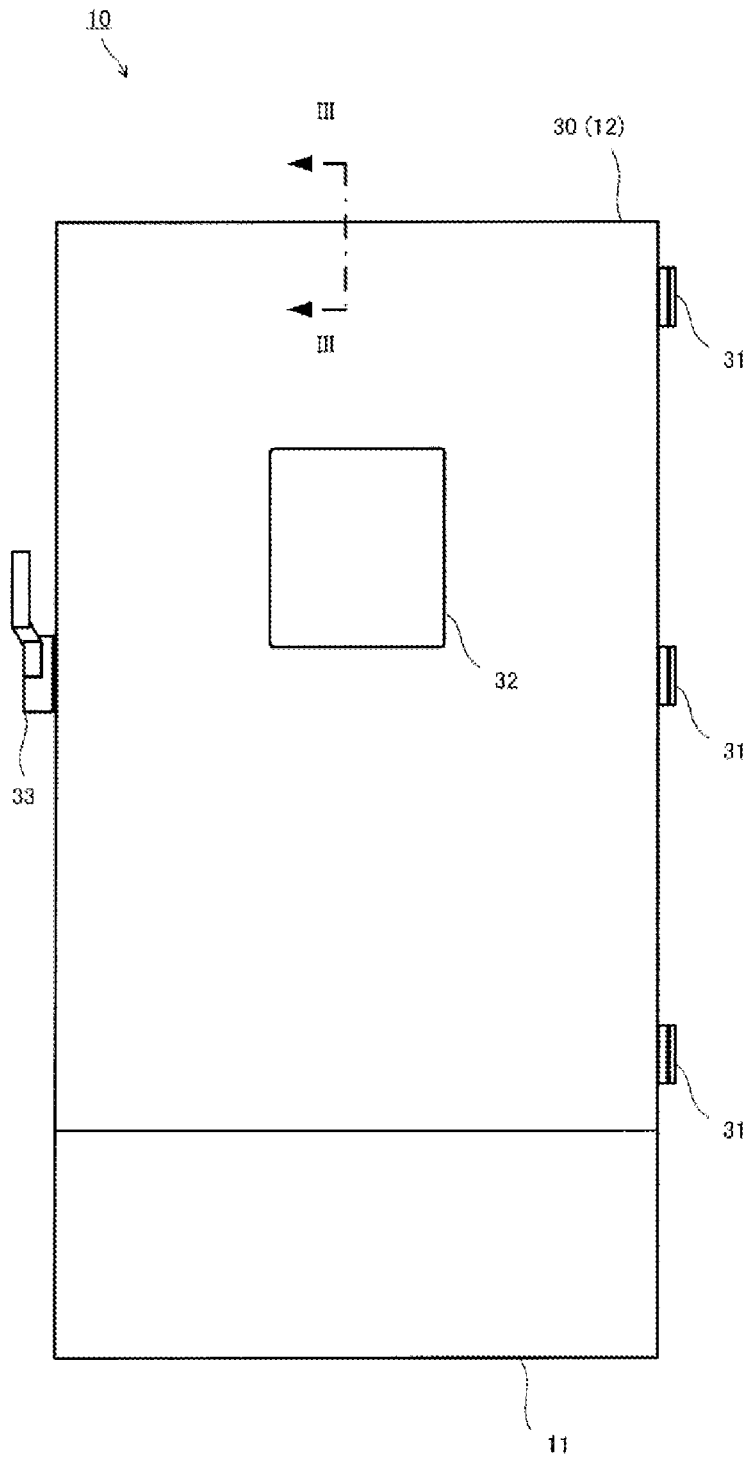
FIG. 1A is a front view of a refrigeration apparatus.
Figure 1B:
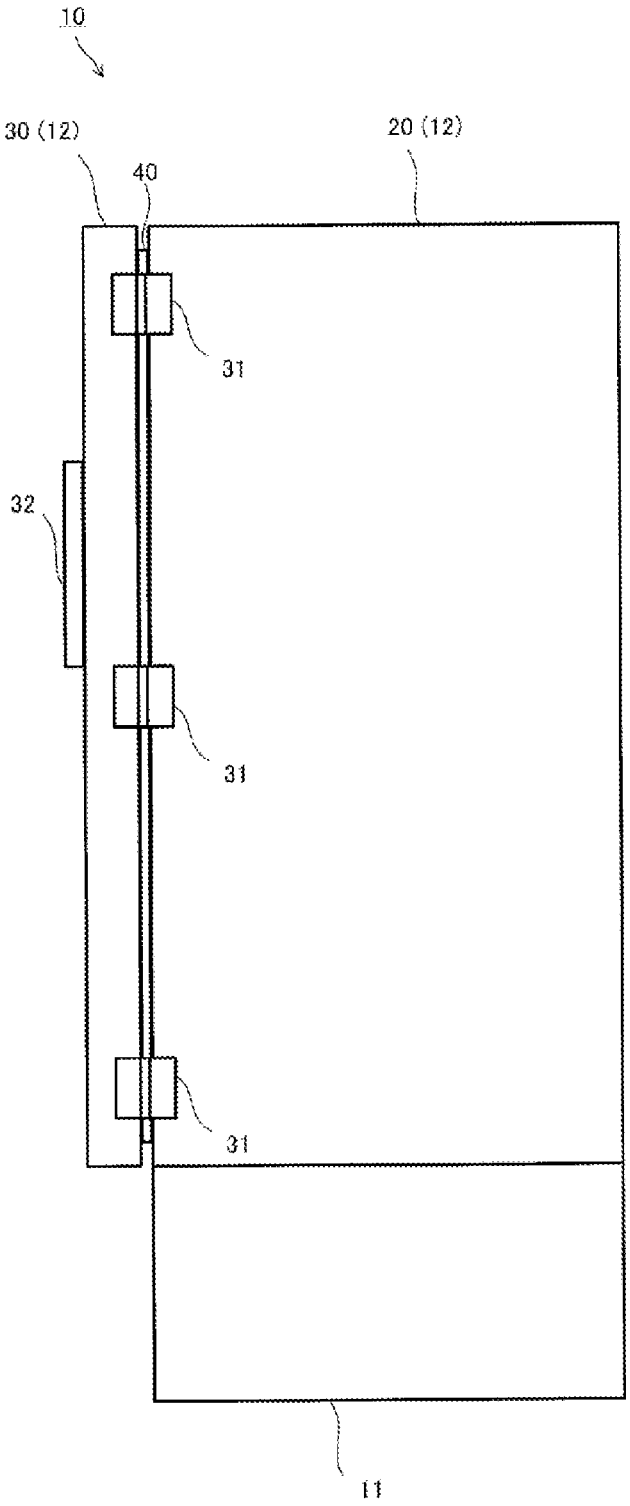
FIG. 1B is a side view of a right surface of the refrigeration apparatus.
Figure 1C:
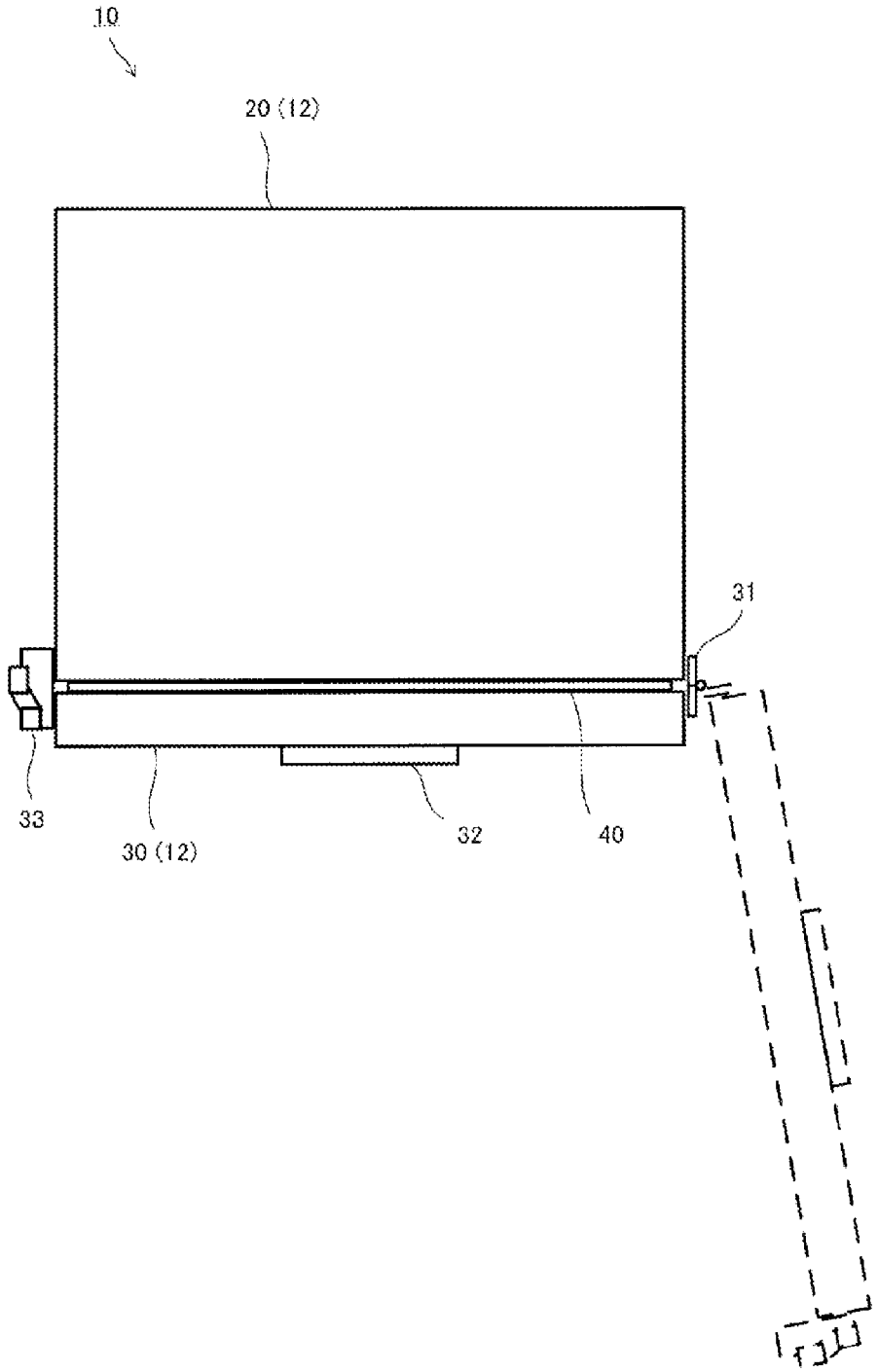
FIG. 1C is a plan view of the refrigeration apparatus.

FIG. 1A, FIG. 1B, and FIG. 1C are respectively a front view, a side view of a right surface, and a plan view of ultra-low temperature freezer 10 that constitutes an example of a refrigeration apparatus according to the present invention. Ultra-low temperature freezer 10 includes machine installing section 11 and main body 12 that is provided on machine installing section 11.

Various types of devices that make up refrigeration circuit 60 (refer to FIG. 5) and a controller are disposed in an interior of machine installing section 11. Refrigeration circuit 60 and the various types of devices that make up refrigeration circuit 60 will be described in detail later.

Main body 12 includes box section 20, and door 30 that is attached to a front surface side of box section 20 in such a manner as to be opened and closed freely. Door 30 is attached to box section 20 via hinges 31. Control section 32, from which instructions for ultra-low temperature freezer 10 are inputted, and knob 33 are attached to door 30. Door 30 is opened as indicated by broken lines in FIG. 1C by operating knob 33. Packing 40 is attached to box section 20.

Figure 2:
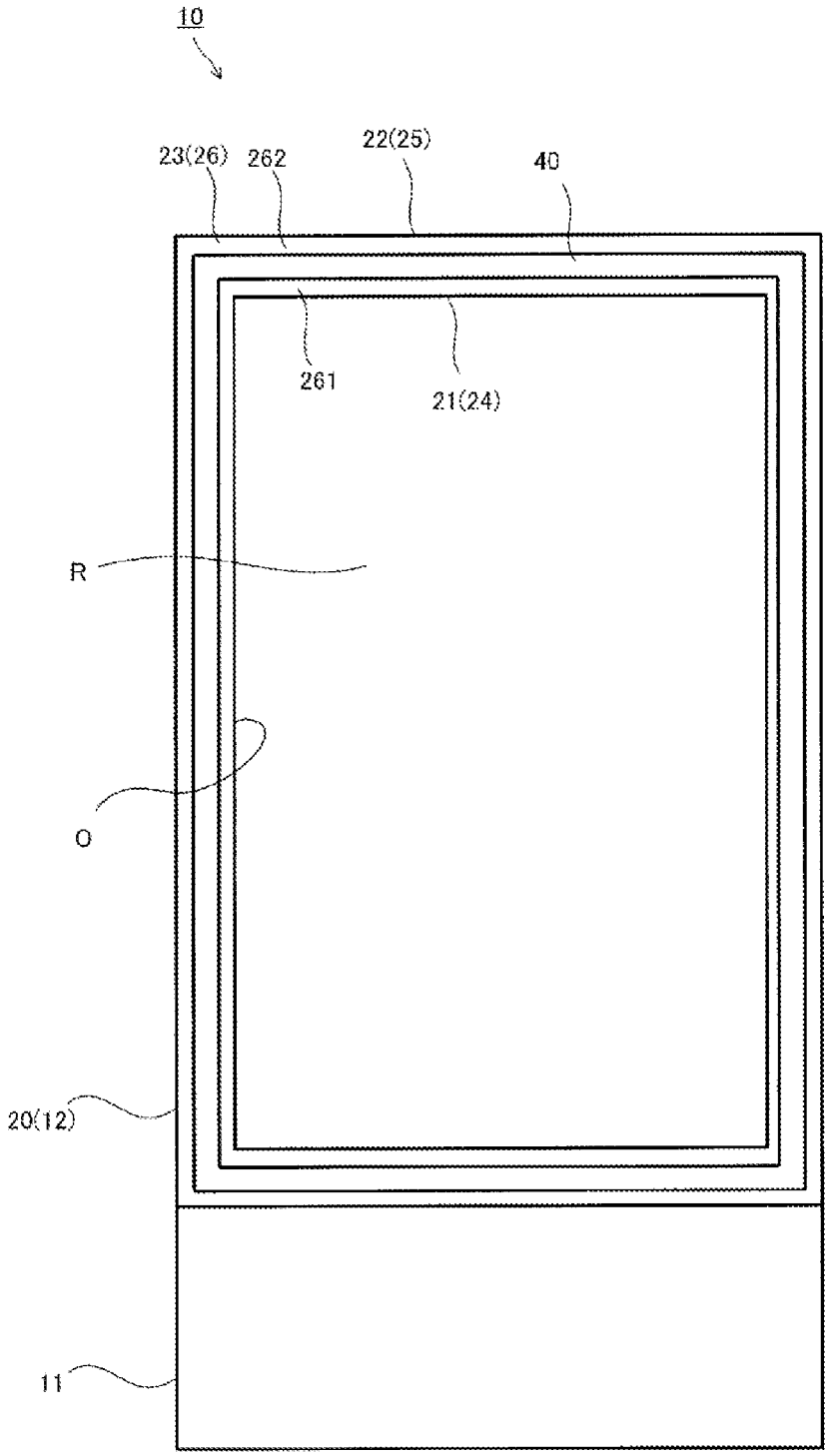
FIG. 2 is a front view of the refrigeration apparatus with a door opened.

FIG. 2 is a front view of ultra-low temperature freezer 10 with door 30 opened. As illustrated in FIG. 2, box section 20 includes cooling compartment R provided in an interior thereof and opening O provided on a front surface side and configured to communicate with cooling compartment R. Box section 20 includes inner box section 21, outer box section 22, and first circumferential edge section 23 (a circumferential edge section of the present invention) that connects inner box section 21 with outer box section 22 and surrounds opening O. In FIG. 2, door 30 and hinges 31 are omitted from illustration.

Figure 3:
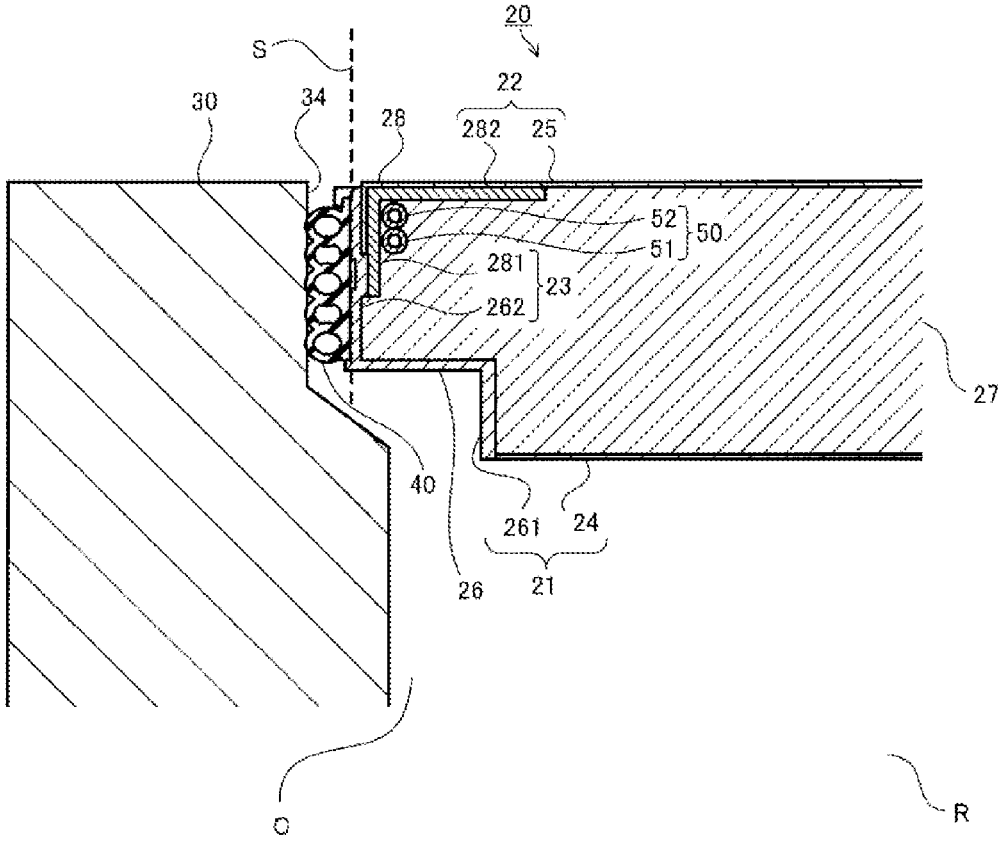
FIG. 3 is a cross-sectional view taken along a line III-III and seen as indicated by arrows in FIG. 1A.

FIG. 3 is a cross-sectional view taken along a line III-III and seen from a direction indicated by arrows in FIG. A. Box section 20 is mainly made up of inner box 24, outer box 25 and circumferential edge member 26, which each are formed of a metallic plate and/or a synthetic resin plate, as well as heat insulating material 27 made of synthetic resin. Circumferential edge member 26 includes inner frame section 261, which constitutes a section having a substantially L-like cross-sectional shape, and outer frame section 262, which constitutes a section having a substantially I-like cross-sectional shape. Inner box 24 and inner frame section 261 are joined together with a bracket and a bolt, not shown. Outer frame section 262 and outer box 25 are joined together with a bracket and a bolt, not shown.

Reinforcement member 28 configured to enhance a mechanical strength of box section 20 is provided in a cornier portion formed by circumferential edge member 26 and outer box 25. Reinforcement member 28 includes a section having a substantially L-like cross-sectional shape and includes first collar section 281 touching circumferential edge member 26 and second collar section 282 touching an inner side of outer box 25. Second collar section 282 extends to an area where packing 40 is held between an outer circumferential portion of door 30 and outer frame section 262. Reinforcement member 28 reinforces a bent portion of outer box 25 and functions as a member for fixing a machine screw (not shown) for joining outer box 25 and circumferential edge member 26 together. It should be noted that reinforcement member 28 may be eliminated in the case where outer box 25 has a desired strength or where outer box 25 can be formed into a shape that enables outer box 25 to be fixed to circumferential edge member 26 with a machine screw.

In ultra-low temperature freezer 10, inner box section 21 is made up of inner frame section 261 and inner box 24. In ultra-low temperature freezer 10, outer box section 22 is made up of outer box 25 and second collar section 282. In addition, in ultra-low temperature freezer 10, first circumferential edge section 23 is made up of outer frame section 262 and first collar section 281.

Door 30 is made up, for example, of a heat insulating member and a metallic plate that surrounds the heat insulating member. Door 30 includes, on an outer circumferential portion thereof, second circumferential edge section 34 that comes to face first circumferential edge section 23 when door 30 is closed. Outer frame section 262 and second circumferential edge section 34 are preferably made to constitute planes parallel to each other to enhance the sealing properties between first circumferential edge section 23 and second circumferential edge section 34 when door 30 is closed. Packing 40 is disposed on outer frame section 262 to enhance the sealing properties between first circumferential edge section 23 and second circumferential edge section 34. Packing 40 may be disposed on second circumferential edge section 34.

Annular pipe 50 (a pipe of the present invention) is disposed further outwards than inner box section 21 and further inwards than outer box section 22, and near first circumferential edge section 23, and this annular pipe 50 has an annular shape to surround inner box section 21. Annular pipe 50 includes first annular pipe 51 on an inner side and second annular pipe 52 on an outer side.

Figure 4A:
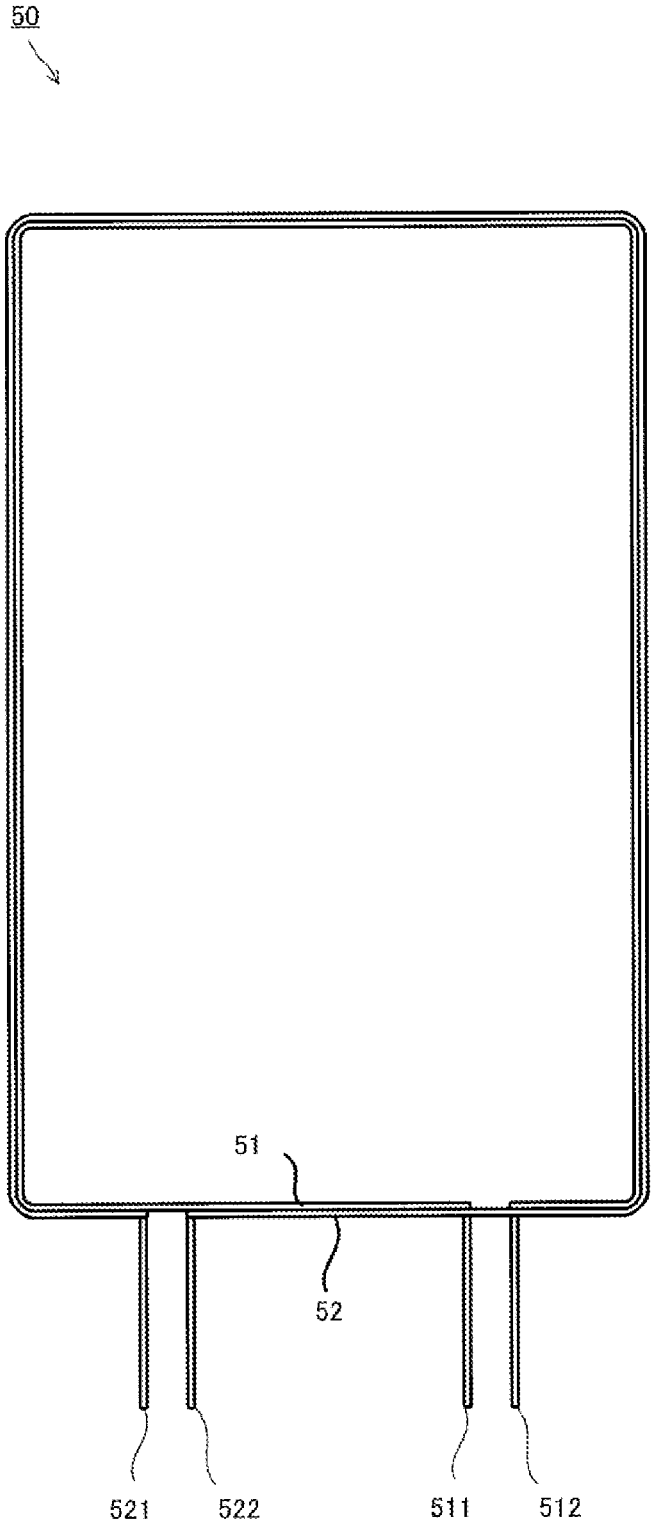
FIG. 4A is a front view of annular pipes.
Figure 4B:
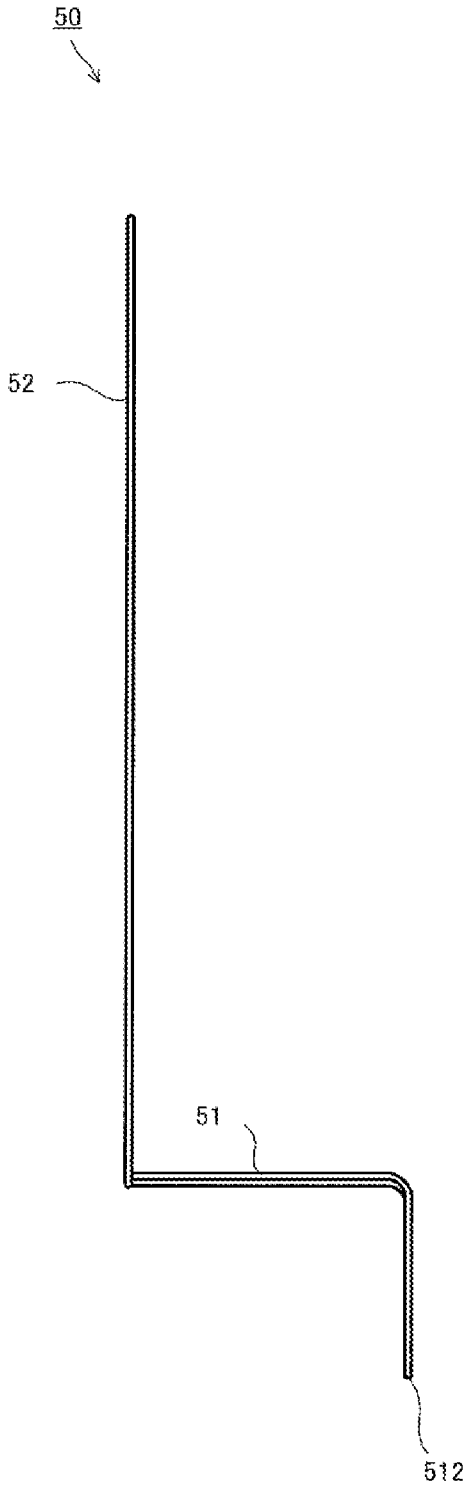
FIG. 4B is a side view of a right surface of the annular pipes.
Figure 4C:
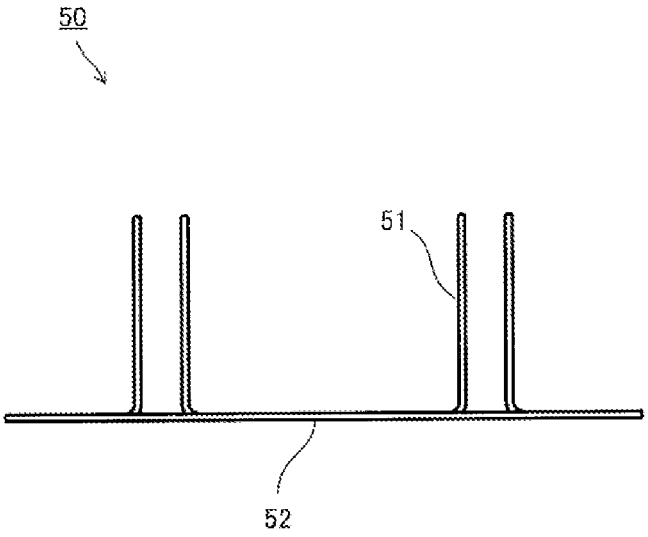
FIG. 4C is a plan view of the annular pipes.

FIGS. 4A, 4B, and 4C are, respectively, a front view, a side view of a right side surface, and a plan view of annular pipe 50. Annular pipe 50 includes first annular pipe 51 and second annular pipe 52 that are independent on each other. Second annular pipe 52 is disposed in such a manner as to be superposed on an outer circumferential side of first annular pipe 51 so as to wrap around first annular pipe 51. First annular pipe 51 and second annular pipe 52 are in contact with each other. A material for first annular pipe 51 and second annular pipe 52 is a metal having a relatively great heat conductivity such as copper or aluminum.

First annular pipe 51 includes first refrigerant inlet 511 that constitutes an inlet for refrigerant and first refrigerant outlet 512 that constitutes an outlet of refrigerant. Second annular pipe 52 includes second refrigerant inlet 521 that constitutes an inlet for refrigerant and second refrigerant outlet 522 that constitutes an outlet of refrigerant.

Figure 5:
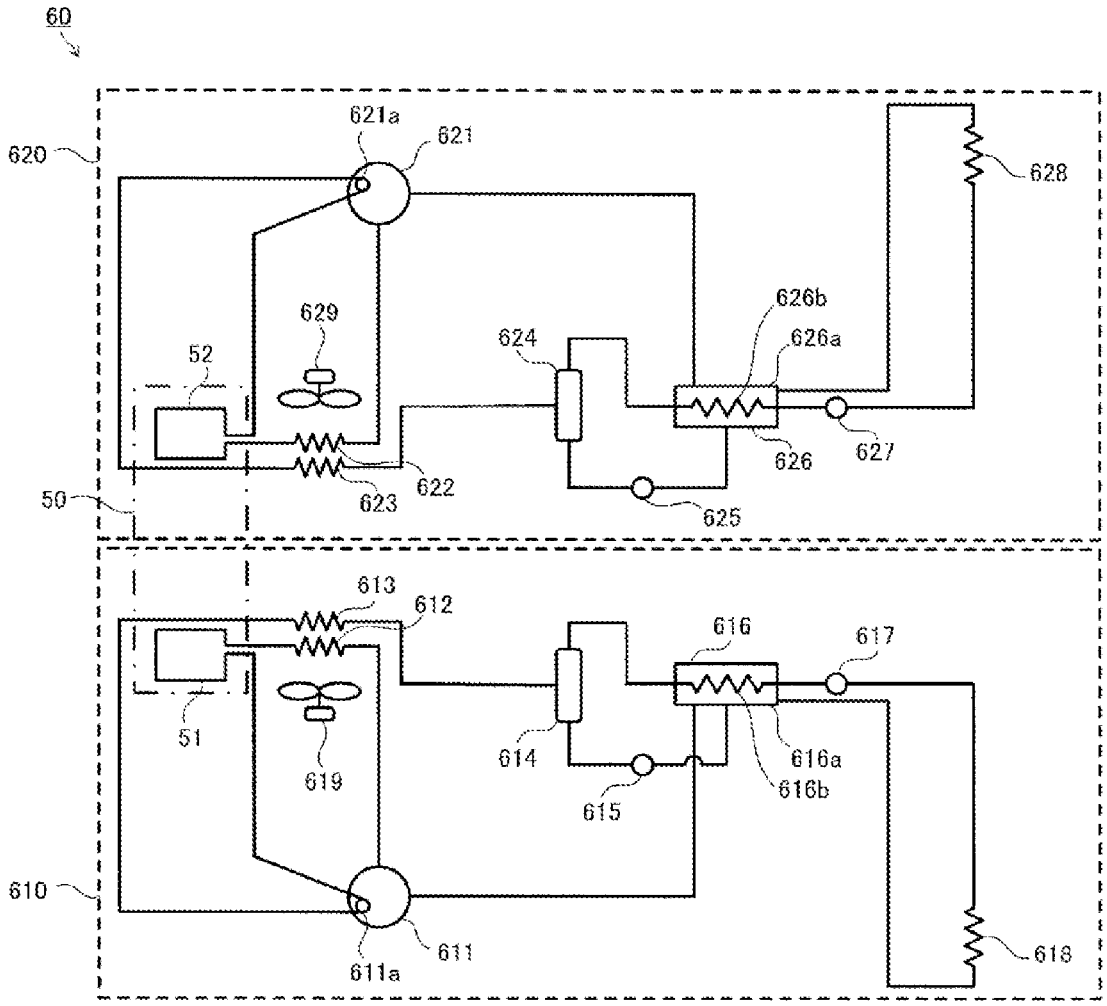
FIG. 5 is a circuit diagram depicting a refrigeration circuit.

FIG. 5 is a cycle diagram illustrating main constituent devices that makes up refrigeration circuit 60. Refrigeration circuit 60 includes first refrigeration circuit 610 and second refrigeration circuit 620 in which refrigerants circulate independently of each other. First refrigeration circuit 610 and second refrigeration circuit 620 can both be operated simultaneously. Alternatively, only either of first refrigeration circuit 610 and second refrigeration circuit 620 can also be operated for the sake of energy conservation or service maintenance of the other.

First refrigeration circuit 610 includes first compressor 611, first pre-condenser 612 and first condenser 613, first separator 614 configured to separate a refrigerant into gas and liquid, first auxiliary decompression device 615 and first cascade condenser 616, and first decompression device 617 and first evaporator pipe 618. These constituent devices are connected together with a predetermined pipe (a first pipe) so that a refrigerant (a first refrigerant) discharged from first compressor 611 returns to first compressor 611. For example, a non-azeotropic mixture refrigerant containing four different refrigerants (hereinafter, referred to simply as a "refrigerant") is sealed in first refrigeration circuit 610.

First refrigeration circuit 610 includes first oil cooler 611*a* in an oil reservoir in first compressor 611 and includes first annular pipe 51 between first pre-condenser 612 and first oil cooler 611*a*.

First compressor 611 compresses a sucked refrigerant and discharges the refrigerant to first pre-condenser 612.

First pre-condenser 612 is made up, for example, of a serpentine copper or aluminum pipe configured to dissipate heat from the refrigerant discharged from first compressor 611.

First condenser 613 is made up, for example, of a serpentine copper or aluminum pipe configured to dissipate heat further from the refrigerant outputted from first pre-condenser 612.

First pre-condenser 612 and first condenser 613 are integrated into, for example, a single pipe plate. First common fan 619 is disposed near first pre-condenser 612 and first condenser 613 to blow air against first pre-condenser 612 and first condenser 613 simultaneously.

First separator 614 separates the refrigerant outputted from first condenser 613 into a liquid-phase refrigerant and a gas-phase refrigerant. After having been so separated, the liquid-phase refrigerant is decompressed in first auxiliary decompression device 615 (for example, a capillary tube), whereafter the decompressed refrigerant evaporates in first outer pipe 616*a* of first cascade condenser 616.

First cascade condenser 616 is made up, for example, of a copper or aluminum duplex pipe including first outer pipe 616*a* and first inner pipe 616*b*. The gas-phase refrigerant from first separator 614 flows into first inner pipe 616*b*. In first outer pipe 616*a*, the liquid-phase refrigerant evaporates to cool the gas-phase refrigerant flowing through first inner pipe 616*b*.

First decompression device 617 (for example, a capillary tube) decompresses a refrigerant that is cooled in first inner pipe 616*b* of first cascade condenser 616 to be in a liquid phase and outputs the decompressed refrigerant to first evaporator pipe 618.

First evaporator pipe 618 is made up, for example, of a copper or aluminum pipe configured to evaporate the refrigerant decompressed in first decompression device 617 and is thermally affixed to an outer surface of inner box 24 excluding opening O thereof in such a manner as to be in contact with the outer surface.

An interior of inner box 24 is cooled by a cooling effect produced when the refrigerant evaporates (vaporizes) in first evaporator pipe 618. The refrigerant that evaporates in first evaporator pipe 618 to be in a gas-phase merges with the refrigerant that has evaporated beforehand in first cascade condenser 616, and both the refrigerants are sucked into first compressor 611.

Second refrigeration circuit 620 has a similar configuration to that of first refrigeration circuit 610. That is, second refrigeration circuit 620 includes second compressor 621, second pre-condenser 622 and second condenser 623, second separator 624 configured to separate a refrigerant into liquid and gas, second auxiliary decompression device 625 and second cascade condenser 626, and second decompression device 627 and second evaporator pipe 628. Constituent devices are connected together by a predetermined pipe (a second pipe) in such a manner that a refrigerant (a second refrigerant) discharged from second compressor 621 returns to second compressor 621 again. A similar refrigerant to the refrigerant used in first refrigeration circuit 610 is also used in second refrigeration circuit 620.

Similar to first refrigeration circuit 610, second refrigeration circuit 620 includes second oil cooler 621*a*, and a second annular pipe 52. Second cascade condenser 626 includes second outer pipe 626*a* and second inner pipe 626*b*.

Second pre-condenser 622 and second condenser 623 are integrated into, for example, a single pipe plate. Second common fan 629 is disposed near second pre-condenser 622 and second condenser 623 to blow air against second pre-condenser 622 and second condenser 623 simultaneously.

As described above, first annular pipe 51 and second annular pipe 52 are disposed further outwards than inner box section 21 and further inwards than outer box section 22, and near first circumferential edge section 23.

In ultra-low temperature freezer 10 configured as has been described heretofore, an interior of cooling compartment R is cooled by first refrigeration circuit 610 and/or second refrigeration circuit 620, specifically, by a refrigerant that flows through interiors or an interior of first evaporator pipe 618 and/or second evaporator pipe 628.

At this time, a temperature in the interior of cooling compartment R becomes lower than that of the atmosphere surrounding cooling compartment R. As a result, there are possibilities that the temperature becomes lower than that of the surrounding atmosphere at a periphery of opening O illustrated in detail in FIG. 3, that is, at any one or more locations of first circumferential edge section 23, a portion of outer box section 22 that lies near first circumferential edge section 23, packing 40, and second circumferential edge section 34. There are possibilities that condensation or frosting is generated at the location or locations where the temperature becomes lower than that of the surrounding atmosphere.

However, ultra-low temperature freezer 10 according to the embodiment includes annular pipe 50 described above. As a result, the periphery of opening O is heated to thereby prevent condensation or frosting from being generated on the periphery of opening O.

Moreover, annular pipe 50 includes first annular pipe 51 and second annular pipe 52 that are disposed in such a manner as to be superposed on each other from inner box section 21 towards outer box section 22 in the position that lies further inwards than outer box section 22 and surrounds inner box section 21.

Thus, an area of a projection drawing of annular pipe 50, in which imaginary plane S including first circumferential edge section 23 indicated by a broken line in FIG. 3 is drawn as a plane of projection, is greater than an area of a projection drawing of a single annular pipe. In addition, the area of the projection drawing of annular pipe 50, in which imaginary plane S is drawn as the plane of projection, is greater than an area of a projection drawing of a plurality of annular pipes that are stacked up in a direction vertical to imaginary plane S.

As a result, an amount of heat conducted from annular pipe 50 to first circumferential edge section 23 through heat conduction and/or heat radiation becomes great. Thus, according to annular pipe 50 configured in the way described above, first circumferential edge section 23 is heated effectively, thereby making it possible to prevent condensation or frosting from being generated on the periphery of opening O.

In addition, annular pipe 50 is in contact with reinforcement member 28 (first collar section 281) that makes up first circumferential edge section 23. Thus, heat of annular pipe 50 is conducted to first circumferential edge section 23 efficiently through heat conduction. Consequently, in ultra-low temperature freezer 10, first circumferential edge section 23 is heated more effectively, thereby making it possible to prevent condensation or frosting from being generated on the periphery of opening O.

Needless to say, the generation of condensation or frosting on the periphery of opening O can, of course, be prevented by heating first circumferential edge section 23 effectively by bringing annular pipe 50 into direct contact with circumferential edge member 26 without involving reinforcement member 28 therebetween.

Additionally, annular pipe 50 is in contact with reinforcement member 28 (second collar section 282) that makes up outer box section 22. Thus, heat of annular pipe 50 is conducted to outer box section 22 efficiently through heat conduction. Consequently, in ultra-low temperature freezer 10, condensation or frosting can be prevented from being generated on the periphery of opening O by heating, in particular, a portion of outer box section 22 that lies near opening O effectively. The same effect can, of course, be obtained by bringing annular pipe 50 into direct contact with outer box 25 without involving reinforcement member 28 therebetween.

First annular pipe 51 and second annular pipe 52, which make up annular pipe 50, are in contact with each other. Thus, even in the case where refrigerant is supplied only to one of first annular pipe 51 and second annular pipe 52, heat can efficiently be conducted from one to the other of first annular pipe 51 and second annular pipe 52 through heat conduction. Consequently, as with a case where refrigerant is supplied to both first annular pipe 51 and second annular pipe 52, the amount of heat conducted from annular pipe 50 to first circumferential edge section 23 through heat conduction and/or heat radiation can be increased. That is, condensation or frosting can effectively be prevented from being generated on the periphery of opening O.

For example, even in the case where only one of first refrigeration circuit 610 and second refrigeration circuit 620 is operated for conservation of energy, the periphery of first circumferential edge section 23 that surrounds opening O can be heated effectively, thereby making it possible to prevent condensation or frosting from being generated on the periphery of opening O.

First annular pipe 51 and second annular pipe 52 may, of course, be spaced away from each other as required.

Ultra-low temperature freezer 10 further includes door 30 attached to box section 20 in such a manner as to be opened and closed freely and including second circumferential edge section 34 that comes to face first circumferential edge section 23 when closed, and annular packing 40 disposed on either first circumferential edge section 23 or second circumferential edge section 34. Thus, cold air is prevented from leaking from cooling compartment R, whereby cooling compartment R is kept at a very low temperature.

Moreover, as illustrated in FIG. 3, an upper end edge of annular pipe 50 is positioned above an upper end edge of packing 40. This is true with the other portions. That is, a lower end edge of annular pipe 50 is positioned below a lower end edge of packing 40 at portions lying below opening O. In addition, at portions on a right side of opening O, a right end edge of annular pipe 50 is positioned on a right side of a right end edge of packing 40. At portions on a left of opening O, a left end edge of annular pipe 50 is positioned on a left of a left end edge of packing 40. That is, when seen from a front surface side, annular pipe 50 is disposed in such a manner that an outer circumferential edge of annular pipe 50 surrounds an outer circumferential edge of packing 40.

Thus, heat can be conducted effectively from annular pipe 50 via first circumferential edge section 23 towards an interface between packing 40 and outside air that is produced when door 30 is closed, that is, an outer circumferential surface of packing 40 and outside air that is in contact with packing 40. Consequently, in ultra-low temperature freezer 10, condensation or frosting can effectively be prevented from being generated on the periphery of opening O.

First circumferential edge section 23 includes first collar section 281, which is a metallic plate member extending from a position lying on an outer side of a circumferential edge of annular pipe 50 to a position lying on an inner side of an inner circumferential edge of annular pipe 50. Since first collar section 281 is made of metal, first collar section 281 can conduct heat of refrigerant flowing through an interior of annular pipe 50 to first circumferential edge section 23 effectively. In other words, first collar section 281 functions as a heat radiation fin configured to conduct heat of the refrigerant flowing through the interior of annular pipe 50 to circumferential edge member 26. Consequently, in ultra-low temperature freezer 10, reinforcement member 28 also contributes to prevention of the generation of condensation or frosting on the periphery of opening O while enhancing the mechanical strength of box section 20.

Figure 6A:
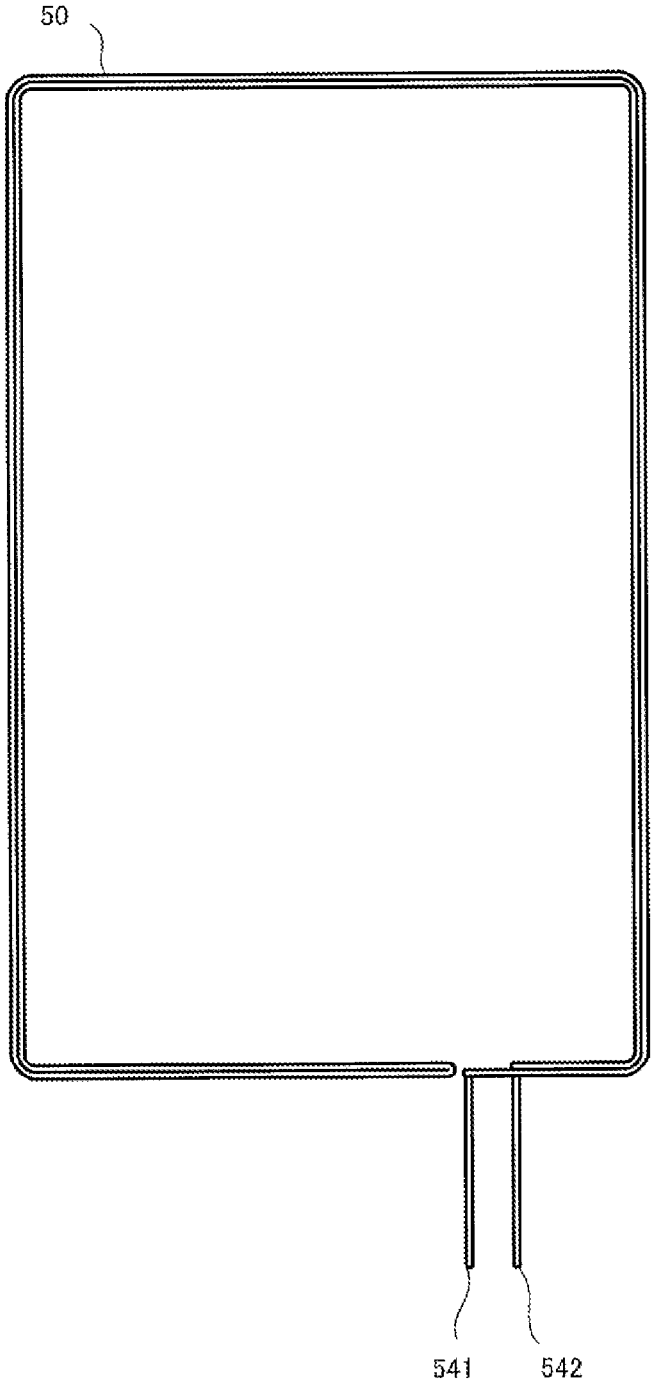
FIG. 6A is a front view of an annular pipe according to another embodiment.
Figure 6B:
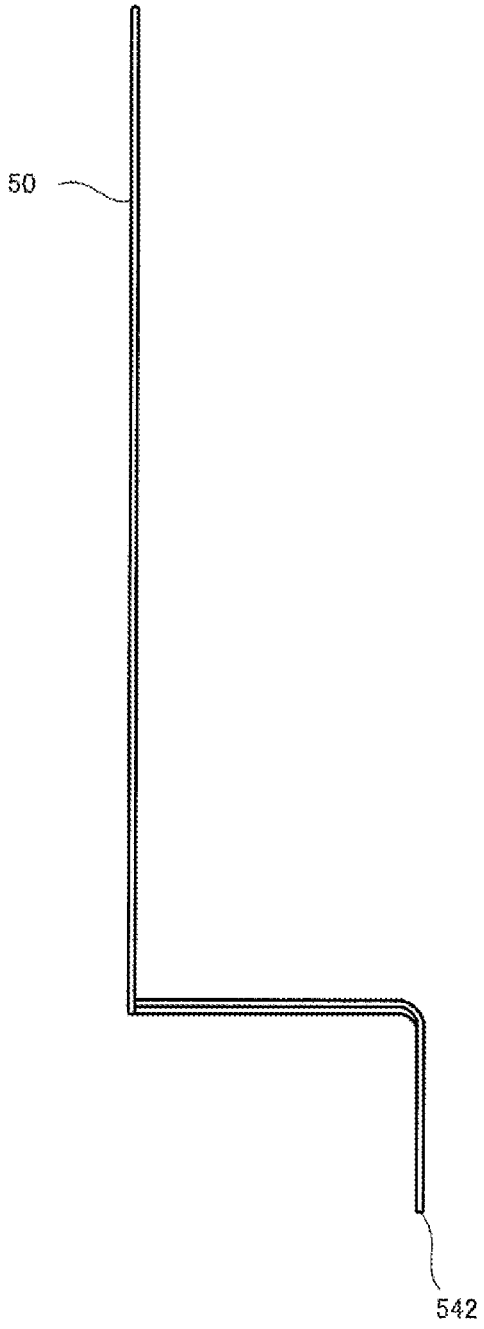
FIG. 6B is a side view of a right surface of the annular pipe according to the other embodiment.
Figure 6C:
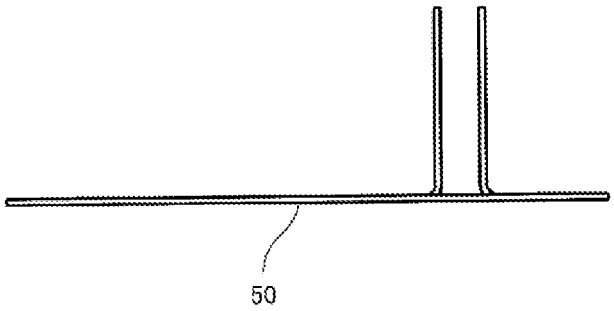
FIG. 6C is a plan view of the annular pipe according to the other embodiment.

In the case where the refrigeration apparatus includes only one refrigeration circuit (for example, first refrigeration circuit 610), or in the case where refrigeration is supplied to annular pipe 50 from only one of a plurality of refrigeration circuits, annular pipe 50 may take a form illustrated in FIGS. 6A, 6B, and 6C.

FIGS. 6A, 6B and 6C are a front view, a side view of a right surface, and a plan view of annular pipe 50 of a modified example, respectively. This annular pipe 50 is formed by bending one pipe and includes two annular pipe sections. This annular pipe 50 includes refrigerant inlet 541 and refrigerant outlet 542. Even with annular pipe 50 configured in this way, as with annular pipe 50 that ultra-low temperature freezer 10 described before includes, condensation or frosting can effectively be prevented from being generated on the periphery of the opening circumferential section that surrounds opening O.

The refrigeration apparatus according to the present invention is not limited to the embodiments described above and hence can, of course, be modified variously. For example, when condensation or frosting needs to be prevented from being generated at a specific portion of the periphery of the opening circumferential section that surrounds the opening of the refrigeration apparatus, the pipe to which heated refrigerant is supplied may not have to have an annular shape, provided that the pipe is disposed in the vicinity of the specific portion.

The details of the disclosure of the specification, claims, drawings and abstract that are included in Japanese Patent Application No. 2017-102872 filed on May 24, 2017 are incorporated herein by reference in its entirety.

INDUSTRIAL APPLICABILITY

According to the present invention, the refrigeration apparatus can be provided in which condensation and frosting can be prevented from being generated on the periphery of the opening circumferential section that surrounds the opening. Thus, the industrial applicability thereof is great.

REFERENCE SIGNS LIST

10 Ultra-low temperature freezer
11 Machine installing section
12 Main body
20 Box section
21 Inner box section
22 Outer box section
23 First circumferential edge section
24 Inner box
25 Outer box
26 Circumferential edge member
261 Inner frame section
262 Outer frame section
27 Heat insulating material
28 Reinforcement member
281 First collar section
282 Second collar section
30 Door
31 Hinge

32 Control section
33 Knob
34 Second circumferential edge section
40 Packing
50 Annular pipe
51 First annular pipe
511 First refrigerant inlet
512 First refrigerant outlet
52 Second annular pipe
521 Second refrigerant inlet
522 Second refrigerant outlet
541 Refrigerant inlet
542 Refrigerant outlet
60 Refrigeration circuit
610 First refrigeration circuit
611 First compressor
611*a* First oil cooler
612 First pre-condenser
613 First condenser
614 First separator
615 First auxiliary decompression device
616 First cascade condenser
616*a* First outer pipe
616*b* First inner pipe
617 First decompression device
618 First evaporator pipe
619 First common fan
620 Second refrigeration circuit
621 Second compressor
621*a* Second oil cooler
622 Second pre-condenser
623 Second condenser
624 Second separator
625 Second auxiliary decompression device
626 Second cascade condenser
626*a* Second outer pipe
626*b* Second inner pipe
627 Second decompression device
628 Second evaporator pipe 629 Second common fan
O Opening
R Cooling compartment
S Imaginary plane

The invention claimed is:

1. A refrigeration apparatus configured to perform cooling through a refrigeration cycle using a refrigerant, the refrigeration apparatus comprising:

a door;

a box section comprising a circumferential edge section that faces an outer circumferential portion of the door with the door closed, wherein an interior of the box section is cooled by the refrigerant;

packing configured to be held between the outer circumferential portion of the door and the circumferential edge section with the door closed; and a plurality of pipes disposed so as to be aligned along a surface of the circumferential edge section, the plurality of pipes circulating the refrigerant that is warmed by a compressing action of a compressor, wherein:

the plurality of pipes individually belong to a plurality of refrigeration circuits in which refrigerants circulate independently of each other, the plurality of pipes comprise a first annular pipe and a second annular pipe that is disposed in such a manner as to be superposed on an outer circumferential side of the first annular pipe so as to surround the first annular pipe, and the box section comprises an inner box section and an outer box section that covers the inner box section, and the box section further comprises a metallic plate member that is fixed to an inner surface of the circumferential edge section and an inner surface of the outer box section, the inner surface of the outer box section being located on a side facing the circumferential edge section.

2. The refrigerant apparatus according to claim 1, wherein the plurality of pipes are in contact with the metallic plate member that is located on an inner surface side of the circumferential edge section.

3. The refrigeration apparatus according to claim 1, wherein in the plurality of pipes, a pipe located on a side facing the outer box section is in contact with the metallic plate member located on an inner surface side of the outer box section.

4. The refrigeration apparatus according to claim 1, wherein the metallic plate member extends to an area where the packing is held between the outer circumferential portion of the door and the circumferential edge section.

5. A refrigeration apparatus configured to perform cooling through a refrigeration cycle using a refrigerant, the refrigeration apparatus comprising:

a door;

a box section comprising a circumferential edge section that faces an outer circumferential portion of the door with the door closed, wherein an interior of the box section is cooled by the refrigerant;

packing configured to be held between the outer circumferential portion of the door and the circumferential edge section with the door closed; and a plurality of pipes disposed so as to be aligned along a surface of the circumferential edge section, the plurality of pipes circulating the refrigerant that is warmed by a compressing action of a compressor, wherein:

the plurality of pipes comprise a first annular pipe and a second annular pipe that is disposed in such a manner as to be superposed on an outer circumferential side of the first annular pipe so as to surround the first annular pipe, and the box section comprises an inner box section and an outer box section that covers the inner box section, and the box section further comprises a metallic plate member that is fixed to an inner surface of the circumferential edge section and an inner surface of the outer box section, the inner surface of the outer box section being located on a side facing the circumferential edge section.

6. The refrigerant apparatus according to claim 5, wherein the plurality of pipes are in contact with the metallic plate member that is located on an inner surface side of the circumferential edge section.

7. The refrigeration apparatus according to claim 5, wherein in the plurality of pipes, a pipe located on a side facing the outer box section is in contact with the metallic plate member located on an inner surface side of the outer box section.

8. The refrigeration apparatus according to claim 5, wherein the metallic plate member extends to an area where the packing is held between the outer circumferential portion of the door and the circumferential edge section.

* * * * *